United States Patent [19]

Marshall et al.

[11] Patent Number: 4,755,800

[45] Date of Patent: Jul. 5, 1988

[54] WINDOW SECURITY DEVICE

[75] Inventors: John M. Marshall, 202 S. Michigan St., South Bend, Ind. 46601; Donald D. Snyder, Niles, Mich.

[73] Assignee: John M. Marshall, South Bend, Ind.

[21] Appl. No.: 74,298

[22] Filed: Jul. 13, 1987

[51] Int. Cl.[4] ..... G08B 13/04; G08B 13/20

[52] U.S. Cl. ..... 340/550; 200/61.93; 200/83 N; 340/541; 340/544; 340/626

[58] Field of Search ..... 340/545, 544, 626, 541, 340/550, 540; 200/61.93, 83 A, 83 B, 83 C, 83 D, 83 N, 83 R, 61.58 R

[56] References Cited

U.S. PATENT DOCUMENTS

| | | | |
|---|---|---|---|
| 1,974,779 | 9/1934 | Lupold et al. | 340/626 X |
| 3,441,924 | 4/1969 | Peek et al. | 340/550 |
| 3,594,763 | 7/1971 | Peek | 340/544 X |
| 4,633,233 | 12/1986 | Marshall et al. | 340/550 |

*Primary Examiner*—Glen R. Swann, III

*Attorney, Agent, or Firm*—Thomas J. Dodd

[57] ABSTRACT

A window security device which operates on differential gas pressure theory to trigger an alarm upon pressure equalization. A plug which completes the electric activator circuit includes biasing springs or similar devices to urge the plug out of contact with the activator circuit to trigger the alarm upon disturbance or breakage of one of the window glazing panels.

4 Claims, 3 Drawing Sheets

WINDOW SECURITY DEVICE

SUMMARY OF THE INVENTION

This invention relates to a security device and will have special but not limited application to an activation device for a window burglar alarm.

The security device of this invention is adapted for use in a window having two or more panes of glass with the gas pressure in the enclosed area between the panes being substantially higher or lower than the surrounding ambient gas pressure. A device which discloses a security device for use in a vacuum environment is shown in U.S. Pat. No. 4,633,233.

The security device of this invention includes a plug which hermetically seals a hole in the window frame. When one of the panels is distributed or broken, pressure equalization takes place, and the plug leaves the hole which breaks an electric circuit to activate the alarm. Various improvements in the plug design are also disclosed.

Accordingly, it is an object of this invention to provide for an improved window security device.

Another object of this invention is to provide for a window security device which operates on differential pressure principles.

Another object of this invention is to provide an improved plug activator for a differential pressure window security device.

Other objects of this invention will become apparent upon a reading of the following description.

DESCRIPTION OF THE PREFERRED EMBODIMENTS

Figure 1:
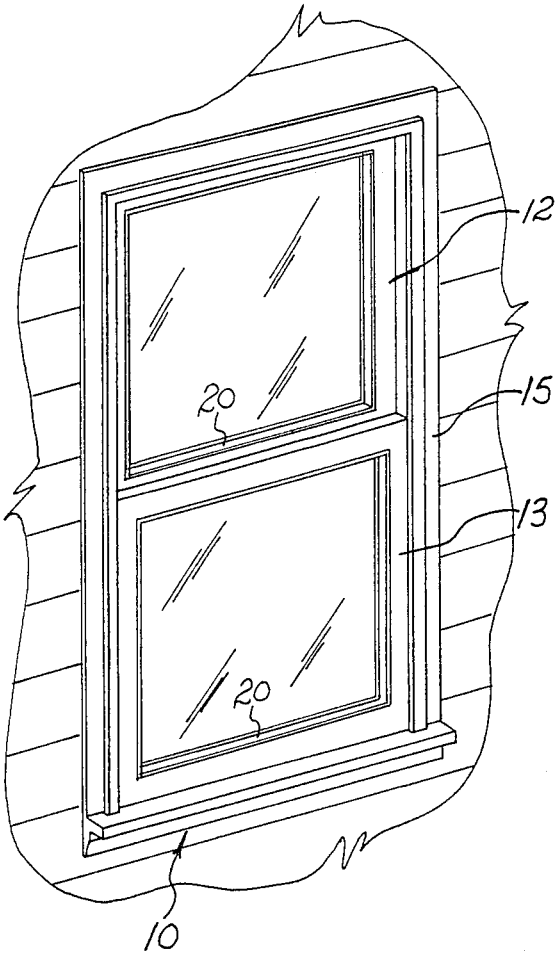
FIG. 1 is a perspective view of a double pane window utilizing the window security device of this invention.
Figure 2:
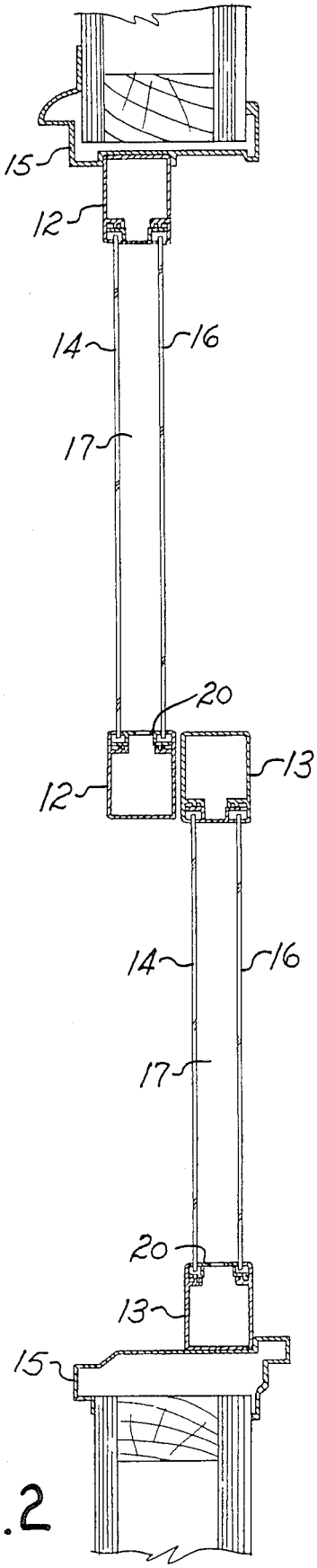
FIG. 2 is a sectional view taken along line 2—2 of FIG. 1.

The preferred embodiments herein described are not intended to be exhaustive or to limit the invention to the precise forms disclosed. They are chosen and described to explain the principles of the invention and their applications to practical uses to thereby enable others skilled in the art to utilize the invention.

Referring now to FIGS. 1–6, reference numeral 10 generally refers to a double glazed window assembly which includes top and bottom sashes 12, 13 into which are carried spaced apart glazing panels 14, 16. For insulation purposes, the space 17 between panels 14 and 16 is filled with pressurized air or gas and then thermosealed, so that the gas pressure in space 17 is greater than the pressure surrounding ambient air. Sashes 12 and 13 fit slidably within frame 15.

Figure 4:
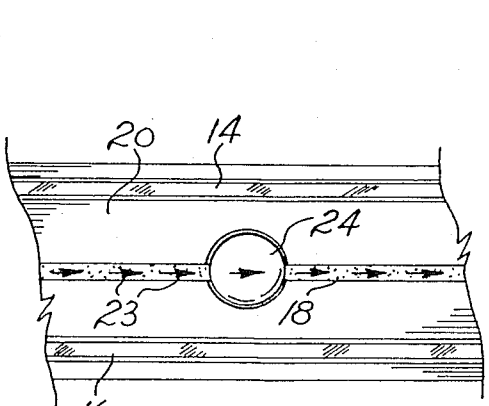
FIG. 4 is a fragementary plan view shown in sectional form of the window of FIG. 3.
Figure 3:
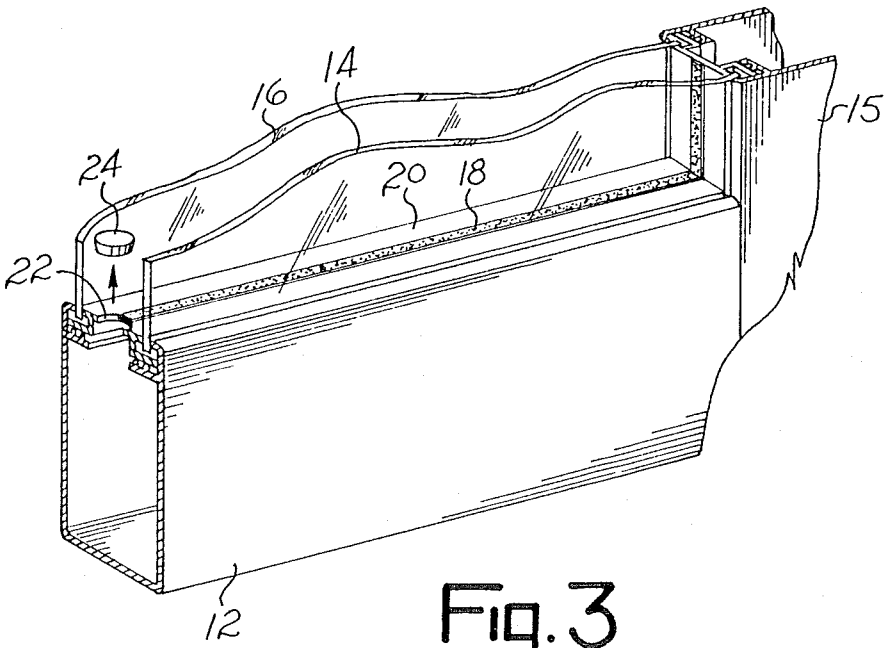
FIG. 3 is a detail fragmentary perspective view of one of the double pane windows of FIG. 1.
Figure 6:
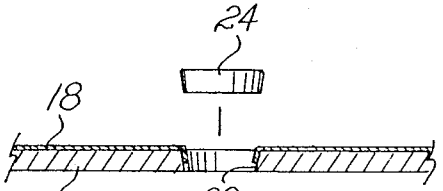
FIG. 6 is a sectional view similar to FIG. 5 showing the action of the plug when one of the windows is broken or disturbed.
Figure 5:
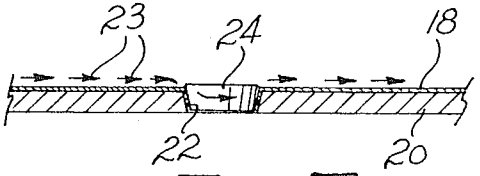
FIG. 5 is a sectional view taken along line 5—5 of FIG. 4.

A continuous conductive member such as metal security tape 18 is secured to spaced plate 20 between glazing panels 14, 16 and is connected to an alarm circuit (not shown). A hole 22 is formed in spacer plate 20 as shown, preferably during assembly of window assembly 10 and interrupts the continuity of tape 18. A plug 24, formed of electrically conductive material, is fitted into hole 22 as shown in FIGS. 3–5 and contacts tape 18 to form a complete circuit (see arrow 23) to the security alarm (not shown). Upon pressurization of the gas in space 17, plug 24 is held in place within hole 22 in contact with tape 18. If one of the glazing panels 14, 16 is disturbed or broken, pressure within space 17 rapidly equalizes with the surrounding air to cause plug 24 to be removed from hole 22 out of contact with tape 18 to actuate the alarm. Plug 24 may be coated with a release agent, such as TEFLON®, to prevent sticking of the plug within hole 22.

Figure 7:
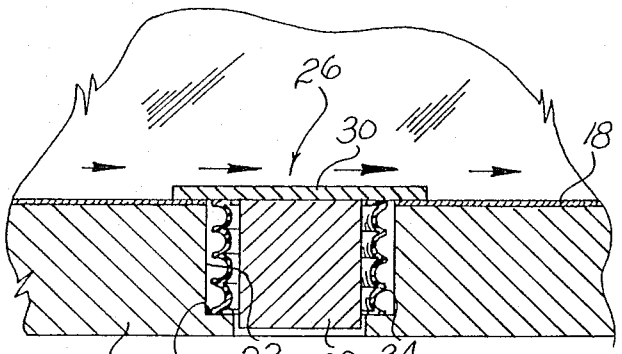
FIG. 7 is a sectional view similar to FIG. 5 showing a first modified plug design.

FIG. 7 depicts a modified plug 26. In this embodiment an internal lower shoulder 28 is defined in spacer plate 20 within hole 22. Plug 26 includes an upper plate 30 of conductive material and a lower body 32. Plate 30 is of a slightly greater dimension than hole 22 and contacts conductive tape 18 as shown, while body 32 is freely fitted within the hole. A biasing member such as flexible bellows 34 extends between plate 30 and shoulder 28 and exerts an upward expansive force on the plate to urge it upwardly out of contact with tape 18. In this embodiment, the gas pressure in space 17 is sufficient to counteract the expansive force of bellows 34 to hold plate 30 against tape 18 to complete the circuit to the security alarm. Should the pressure in space 17 be diminished, as by breaking or disturbing one of glazing panels 14, 16, bellows 34 urges plate 30 out of contact with tape 18 to break the circuit which activates the security alarm (not shown).

Figure 8:
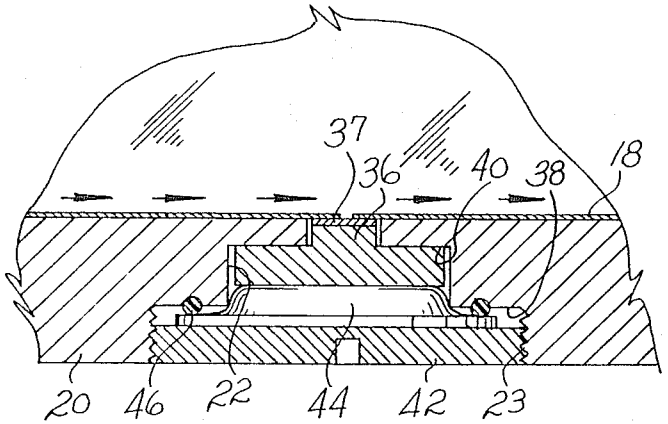
FIG. 8 is a sectional view similar to FIG. 5 showing a second modified plug design.

FIG. 8 depicts a second modified plug 36. In this embodiment, coaxial internal shoulders 38, 40 are defined in spacer plate 20 within hole 22 as shown, and the area defined by space 17 is at a considerably lower than the surrounding ambient air. A cap 42 is threadably secured to hole side wall 23 to seal hole 22 against air leakage into space 17. A flexible diaphragm 44 is secured about the periphery of cap 42 and held in place by O-ring seal 46. Plug 36 is preferable of the T-shape shown in FIG. 8 with its upper 37 contacting tape 18 to complete the electric circuit to the alarm. Due to the low pressure, diaphragm 44 is in an upwardly bowed state as shown and supports plug 36 in this position. In the event of pressure increase due to disturbance or breaking of one of glazing panels 14 or 16, diaphragm 44 will flex downwardly and plug 36 will fall by gravity to break contact with tape 18 to open the circuit and activate the alarm.

Figure 9:
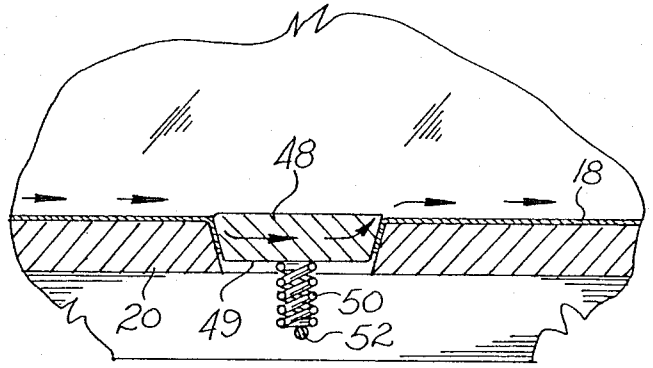
FIG. 9 is a sectional view similar to FIG. 5 showing a third modified plug design.
Figure 10:
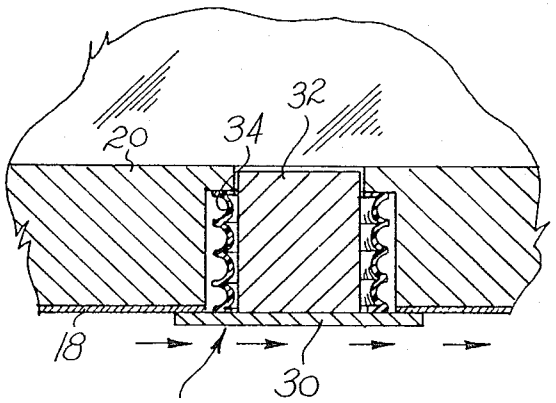
FIG. 10 is a sectional view showing the plug of FIG. 7 positioned in the window frame where a vacuum exists between the window glazing panels.

FIG. 9 depicts another modified plug 48. In this embodiment the space 17 is again at a significantly higher pressure than the surrounding ambient air. Plug 48 includes a biasing member such as spring 50 connected to plug lower wall 49. Spring 50 bears upon a bar or other suitable member 52 secured below spacer plate 20. When gas pressure in space 17 decreases, due to breaking or disturbing one of glazing panels 14, 16, spring 50 urges plug 48 out of contact with tape 18 to open the circuit and activate the security alarm.

It should be noted that plugs 26, 36 and 48 can all be utilized in conjunction with an alarm according to the principles of this invention so long as a pressure differential exists between the gas in space 17 and surrounding ambient pressure. This pressure differential may be higher or lower pressure within space 17 with the positioning of the respective plug and construction of hole 22 dependent upon the type of pressure differential which positioning would be clear to one skilled in the art upon heading the above description.

What is claimed is:

1. In combination, a window security device and a window having spaced apart glazing panels secured to a frame to form an enclosed area between the glazing panels, said enclosed area having an internal gas pressure which is substantially different from gas pressure surrounding said enclosed area, said security device comprising an electric activator circuit positioned within said enclosed area and adapted for connection to an alarm, said activator circuit interrupted by a hole defined in said frame, to normally trigger an alarm, and a plug member fitted within said hole and completing said cirucit, said plug member including biasing means for urging the plug member out of said hole upon disturbance of one of the glazing panels to trigger said alarm.

2. The combination of claim 1 wherein said frame defines an internal shoulder within said hole, said plug member including a central section fitted in said hole and an end plate which is larger than said hole formed of electrically conductive material for completing said activator circuit, said biasing means including a bellows positioned between said end plate and shoulder to urge the plug member out of contact with the activator circuit upon disturbance of one of said glazing panels.

3. The combination of claim 1 wherein the internal gas pressure is significantly greater than the surrounding gas pressure, said frame including a bar positioned adjacently below said hole, said plug biasing means including a spring extending between said plug and said bar, said spring for exerting a compressive force on said plug to urge the plug out of said hole to activate said alarm upon disturbance of one of the glazing panels.

4. The combination of claim 1 and a cap member connected to said frame between said glazing panels, said biasing means including a flexible diaphragm extending from said cap member into said hole, said plug supported by said diaphragm wherein said diaphragm collapses upon pressure equalization due to disturbance of one of said glazing panels to remove said plug from contact with said activator circuit to trigger said alarm.

* * * * *